United States Patent [19]

Garthaffner et al.

[11] Patent Number: 4,596,257

[45] Date of Patent: Jun. 24, 1986

[54] METHOD AND APPARATUS FOR TIPPING SMOKING ARTICLES

[75] Inventors: Martin T. Garthaffner, Midlothian; Bill J. Keen; Jack C. Wheless, both of Richmond, all of Va.

[73] Assignee: Philip Morris Incorporated, New York, N.Y.

[21] Appl. No.: 626,553

[22] Filed: Jun. 29, 1984

[51] Int. Cl.[4] ..... A24C 5/52

[52] U.S. Cl. ..... 131/94

[58] Field of Search ..... 131/94, 95

[56] References Cited

U.S. PATENT DOCUMENTS

| | | | |
|---|---|---|---|
| 1,213,061 | 1/1917 | Baldwin | 131/94 |
| 1,608,138 | 11/1926 | Ruau | 131/94 |
| 1,995,622 | 3/1935 | Müller | 131/5 |
| 2,093,437 | 9/1937 | Gwinn | 131/94 |
| 2,118,508 | 5/1938 | Gwinn et al. | 131/94 |
| 2,162,424 | 6/1939 | Edwards | 131/39 |
| 2,165,144 | 7/1939 | Lubbock | 131/39 |
| 2,172,804 | 9/1939 | Molins | 131/39 |
| 2,188,998 | 2/1940 | Edwards | 131/94 |
| 2,786,472 | 3/1957 | Creuzberg | 131/94 |
| 2,802,470 | 8/1957 | Treble | 131/94 |
| 2,809,640 | 10/1957 | Oldenkamp | 131/94 |
| 2,918,923 | 12/1959 | Morris | 131/94 |
| 3,016,905 | 1/1962 | Creuzburg | 131/94 |
| 3,036,581 | 5/1962 | Dearsley | 131/94 |
| 3,081,778 | 3/1963 | Dearsley | 131/94 |
| 3,094,128 | 6/1963 | Dearsley | 131/94 |
| 3,269,393 | 8/1966 | Ackermann | 131/94 |
| 3,380,459 | 4/1968 | Schmermund | 131/94 |
| 3,470,884 | 10/1969 | McArthur | 131/94 |
| 3,473,536 | 10/1969 | Oesterling et al. | 131/94 |
| 3,483,873 | 12/1969 | Hinzmann | 131/94 |
| 3,506,017 | 4/1970 | Schubert | 131/94 |
| 3,518,999 | 7/1970 | Milner | 131/94 |
| 3,527,234 | 9/1970 | Hinzmann | 131/94 |
| 3,878,852 | 4/1975 | Van Hall | 131/94 |
| 4,023,577 | 5/1977 | Preston et al. | 131/94 |
| 4,111,740 | 9/1978 | Molins et al. | 156/498 |
| 4,191,198 | 3/1980 | Chopko et al. | 131/76 |
| 4,238,993 | 12/1980 | Brand et al. | 131/94 |
| 4,431,010 | 2/1984 | Seragnoli | 131/94 |
| 4,445,519 | 5/1984 | Hinz et al. | 131/94 |

FOREIGN PATENT DOCUMENTS

| | | |
|---|---|---|
| 682379 | 2/1965 | Italy . |
| 687878 | 2/1953 | United Kingdom . |
| 856723 | 12/1960 | United Kingdom . |

*Primary Examiner*—V. Millin
*Assistant Examiner*—H. Macey
*Attorney, Agent, or Firm*—Jeffrey H. Ingerman

[57] ABSTRACT

A method and apparatus are disclosed for wrapping tipping material about an assembly comprising a non-circular tobacco rod and non-circular filter plug, the assembly having a circumference less than that of a standard cigarette, on a standard cigarette tipping machine. The cigarette assembly is rolled along the surface of a rolling drum by an adjacent pressure element that is moved in the same direction as, but with a different speed from that of, the peripheral surface of the drum. The difference in speed causes the cigarette assemby to roll along the drum surface from one of a plurality of uniformly spaced-apart receiving flutes to one of a plurality of uniformly spaced-apart discharge flutes distinct from the receiving flutes. The spacing between adjacent discharge flutes is the same as that between adjacent receiving flutes, but the two sets of flutes are offset one from the other. Suction is applied selectively, exclusively to the receiving flutes near the feed point of the drum, and exclusively to the discharge flutes near the transfer point.

11 Claims, 7 Drawing Figures

METHOD AND APPARATUS FOR TIPPING SMOKING ARTICLES

BACKGROUND OF THE INVENTION

The present invention pertains generally to methods and apparatus for tipping smoking articles, and pertains more especially to such methods and apparatus for tipping oval smoking articles.

In the manufacture of smoking articles, particularly cigarettes, it is conventional to make a continuous tobacco rod (a paper tube filled with shredded tobacco or tobacco substitute) and to cut the continuous rod to the length of individual cigarettes. A continuous rod of filter material is extruded and cut into lengths. The resulting filter plugs are collected in trays and placed in the hopper of a tipping machine, which cuts the filter plugs to twice the length of a single filter, joins each double-length filter plug to two filterless cigarettes, and severs the resulting assembly to form two complete cigarettes.

The filter plugs are gravity-fed from the hopper into flutes or grooves in the periphery of a rotating drum. The filter plugs are held in place in the flutes by means of vacuum suction exerted from the drum interior. The filter plugs can be passed from one such drum to another by proper timing of the rotations of the two drums, and by simultaneously deactivating the suction applied to a particular groove of the first drum as that groove comes face-to-face with a groove of the second drum. This permits a filter plug in the first flute to be pulled over into the opposing flute of the second drum by the suction applied to the latter. The filter plugs passed in this manner from one drum to another eventually are transferred to the flutes of a feed drum. In each flute two previously-deposited cigarette rods flank the filter plug end-to-end.

A web of cork or other tipping material is drawn from a roll thereof and has glue applied to one side. The web is cut off in lengths by cork knives, and one edge of each length is applied to a filter-plug-and-cigarette assembly in such a manner as to extend over the entire length of the filter plug and to overlie a small portion of each cigarette rod, the adhesive on the tipping material sticking to the plug and the rod.

The resulting double cigarette assembly is transferred to a rolling drum, beside which is a metallic rolling block. Each cigarette assembly is rolled along the rolling block by the drum. The rolling action wraps the tipping material around the cigarette assembly, to which it adheres as a result of the glue. Suitable heating elements in the rolling block commonly are used to cure the adhesive rapidly.

The double cigarette assembly is then transferred to a cutter drum, which moves the assembly past a disc knife that severs it into two complete cigarettes. The cigarettes are then inspected and moved to a discharge point, from which they are taken to another machine for packing.

The conventional tipping machine described above is designed to handle cigarettes of circular cross section. It would be desirable to be able to adapt a standard cigarette tipping machine for use in the rapid, economical large-scale manufacture of cigarettes having an oval cross section, which have hitherto largely been a luxury product requiring special equipment for virtually every stage of their manufacture. Various problems arise in making such an adaptation.

For example, it is difficult to transfer oval filter plugs from the hopper to a drum of the conventional type in such a manner that every flute will contain a filter plug and so that each filter plug will have the same predetermined orientation about its longitudinal axis (hereinafter, "angular orientation"). In addition, it has been found to be impossible, as a practical matter, to wrap tipping material around a cigarette assembly having an oval cross section, using standard tipping machine equipment. Related copending applications Ser. No. 480,809, filed Mar. 31, 1983, now U.S. Pat. No. 4,535,790, entitled "Method and Apparatus for Aligning Oval Cigarette Filters," and Ser. No. 584,366, filed Feb. 28, 1984, entitled "Method and Apparatus for Tipping Smoking Articles," both assigned in common herewith, are directed to solutions of these problems.

Another problem arises when it is desired to use a standard tipping machine to wrap tipping material around an oval cigarette assembly having a circumference smaller than the circumference of a standard cigarette. The rolling drum of a standard tipping machine has a particular diameter and a particular number of flutes spaced evenly about its circumference for transferring cigarette assemblies on and off the drum. Each cigarette assembly rolls back two flutes along the drum circumference as tipping material is rolled around it.

The arc length along the drum circumference between flutes is not critical when rolling a circular cigarette, because the rolling distance, two flutes, for different circumference cigarettes is fixed. The number of revolutions necessary for rolling any given circumference circular cigarette two flutes can be controlled by varying the length of the rolling block. On one standard cigarette making machine, the distance between flutes is one-and-one-half times the circumference of a standard cigarette, so that a standard cigarette makes one-and-one-half revolutions as it rolls from flute to flute. If a circular cigarette having a smaller circumference is rolled on the machine, it will roll a greater number of times but, because it is circular, its angular orientation when it reaches the second and third flutes will be indistinguishable from that of a circular cigarette of any other circumference.

However, when tipping oval or other non-circular cigarettes, it is desirable to have all cigarettes in a particular angular orientation on the various drums (except while they are actually being rolled), especially at the transfer points between drums. One preferred orientation for an oval cigarette is that in which the major axis of the cross section of the cigarette is parallel to a line tangent to the drum surface at the point of contact between the drum and the cigarette.

If a cigarette has the circumference of a standard cigarette for which the machine was designed, it will make one-and-one-half revolutions as it rolls between flutes, even if it is oval. Assuming that it starts at the preferred angular orientation, it will finish at that orientation. However, if an oval cigarette has a circumference smaller than the standard circumference and it starts at the preferred angular orientation, it will finish at an angular orientation other than that which is desired.

This problem can be solved by making the rolling drum smaller to decrease the distance between the flutes while maintaining the same number of flutes, or by adding flutes to the drum. However, implementing either of these alternatives would require changing the size, location, and/or speed of rotation of some or all of the other drums in the machine. Further, additional flutes can only be added to the drum without changing its size in those cases where the ratio of the desired circumference to the standard circumference is equal to the ratio of the standard number of flutes to the desired number of flutes, so that the flutes can be spaced evenly about the drum.

It is therefore the principal object of the invention to provide a method and apparatus for applying tipping material to a filter plug and tobacco rod of oval cross section and wrapping the tipping material therearound, while rolling the cigarette assembly a predetermined number of times to maintain a desired angular orientation, regardless of the circumference of the cigarette.

Another object of the invention is to achieve the foregoing objects in a manner which permits the ready and easy adaptation of existing tipping machines to the production of oval cigarettes of non-standard circumference.

SUMMARY OF THE INVENTION

The foregoing objects are attained by the method and apparatus of the invention, according to which an oval cigarette assembly is provided at a feed point in a predetermined orientation in a receiving flute on the peripheral surface of a rolling drum having a plurality of uniformly spaced-apart receiving flutes and a plurality of uniformly spaced-apart discharge flutes on the peripheral surface thereof, the discharge flutes being distinct from the receiving flutes, the distance between adjacent ones of the discharge flutes being the same as the distance between adjacent ones of the receiving flutes. Suction is applied selectively from the interior of said rolling drum exclusively to the receiving flutes in a first region near the feed point, the drum is rotated until the cigarette assembly contacts a first pressure element, and the suction on the receiving flute is deactivated. The rolling drum is advanced rotationally and the pressure element is advanced about the surface of the rolling drum, but the angular speed of the pressure element is slower than that of the surface of the rolling drum, causing the cigarette assembly to roll back along the surface of the rolling drum to the first one of the discharge flutes following the receiving flute in which it started. The rolling drum is advanced until the cigarette assembly clears the pressure element, at which point suction is selectively applied from the interior of the rolling drum exclusively to the discharge flutes in a second region where the cigarette assembly clears the pressure element. The rolling drum is rotated further until the cigarette asssembly reaches a transfer point, at which point the suction on the discharge flute is deactivated and the cigarette assembly is transferred to a transfer drum.

The selective application of suction is controlled by a vacuum valve within the rolling drum. The valve has at least one orifice in the first region which is located to communicate with a vacuum chamber within the valve and with ports leading exclusively to the receiving flutes as they pass through that region, and at least one orifice in the second region which is located to communicate with the vacuum chamber within the valve and with ports leading exclusively to the discharge flutes as they pass through that region. Preferably, there is one orifice in fluid communication with the vacuum chamber and the ports leading to the receiving flutes and there are two narrow elongated orifices in fluid communication with the vacuum chamber and the ports leading to the discharge flutes.

BRIEF DESCRIPTION OF THE DRAWINGS

These and other objects and features of the invention are shown in the following detailed description of the preferred embodiment of the invention, taken in conjunction with the accompanying figures, in which like reference characters refer to like elements throughout, and in which.

DETAILED DESCRIPTION OF THE PREFERRED EMBODIMENT

A tipping machine incorporating the invention moves oval filter plugs from a hopper along a path on which they are cut to twice the length of a single filter and mated end to end with oval filterless cigarettes supplied from a cigarette maker, in a predetermined orientation. Tipping material in sheet form, such as cork or tipping paper, is drawn from a roll and has an adhesive applied to one side of it. The tipping material is then cut into lengths, or patches, each of which is attached to an assembly comprising two filterless cigarettes abutting a double-length filter plug between them end-to-end. The rolling drum assembly of the present invention is used to wrap the patch of tipping material around the oval cigarette assembly, firmly securing the filter plug to the tobacco rods. The cigarette assembly is then cut into two oval cigarettes and delivered to the output point of the tipping machine to be transported to the next work station.

Figure 1:
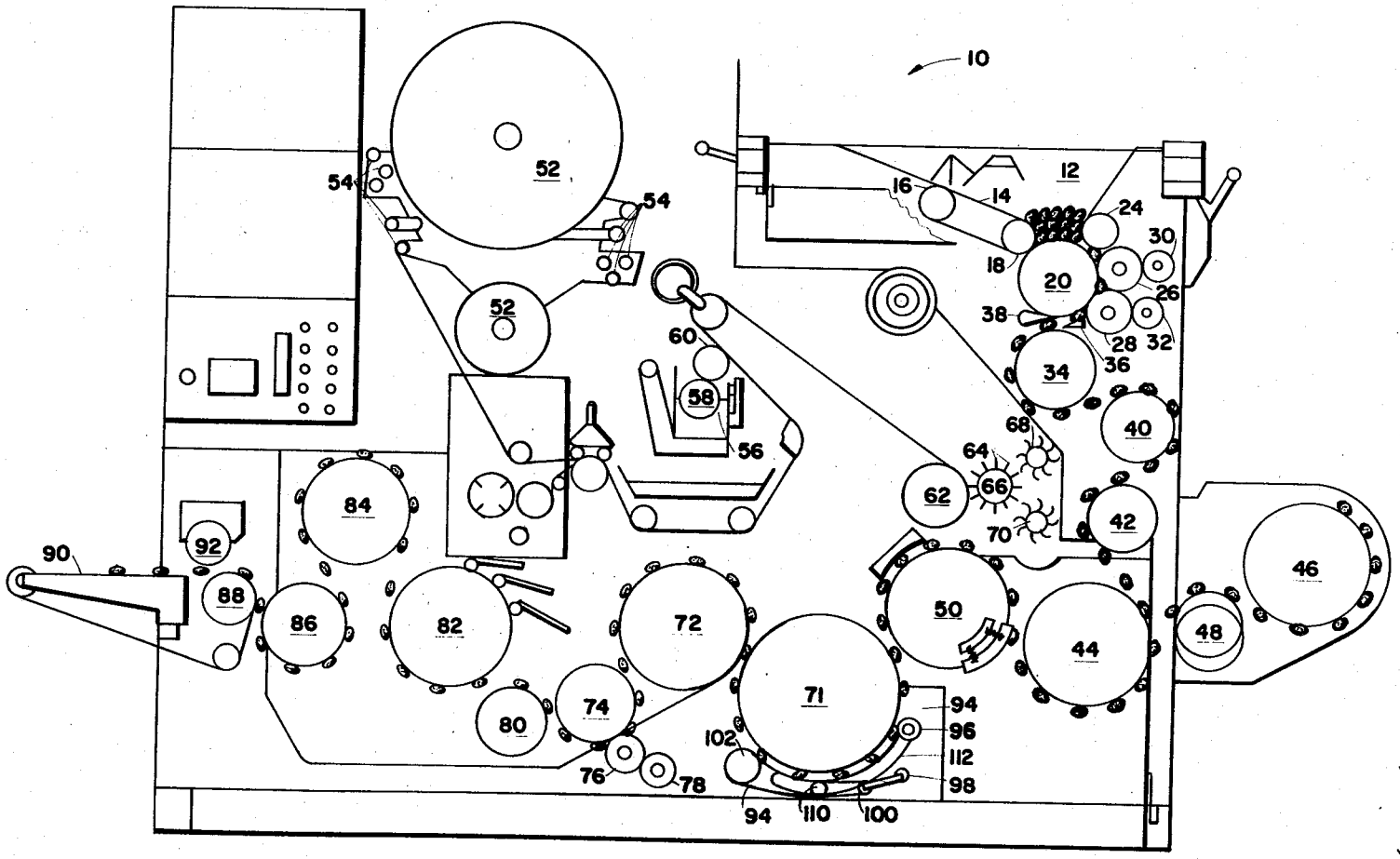
FIG. 1 is a somewhat schematic elevational view of a tipping machine incorporating apparatus for carrying out the method of the invention.

FIG. 1 shows an overview of such a tipping machine 10. The tipping machine 10 has a hopper 12 in which filter plugs two, four times or six times as long as needed for one cigarette are received. Adjacent the bottom opening of the hopper 12, on one side, is a continuous belt 14 mounted on two rollers 16, 18, which drive the belt 14 so as to feed filter plugs downward toward the bottom opening of the hopper 12.

A plug drum 20, described in detail in copending application Ser. No. 480,809, is mounted for rotation about a horizontal axis below the bottom opening of the hopper 12. The plug drum 20 has evenly spaced flutes (not shown) around its circumference and includes a conventional mechanism in its interior for applying vacuum suction to selected flutes. As the filter plugs reach the bottom of the hopper 12, each is received in a flute on the plug drum 20 and is held there by means of suction. The rotation of the drum 20 carries the plug out of the hopper 12. To prevent filter plugs not firmly seated in flutes from leaving the hopper 12, a refuser roller 24 is disposed adjacent the hopper opening on the side toward which the filter plugs move as they leave the hopper, i.e., the side opposite the feeder belt 14. The refuser roller 24 rotates in such a direction as to tend to knock filter plugs back into the hopper 12 (clockwise in FIG. 1), and is spaced from the plug drum 20 such a distance that a filter plug seated in a flute will clear the refuser roller 24 while a filter plug lying on the periphery of the drum and not in a flute will be kept in the hopper 12 by the refuser roller 24.

Adjacent the plug drum 20 are two slitter disc knives 26, 28 mounted for rotation about respective horizontal axes. The knives 26, 28 are positioned so as to cut each filter plug into three segments of equal length. (If the filter plugs in the hopper 12 are only four times the length of one filter, only one of the two slitter knives shown is needed.) Grinding wheels 30, 32 adjacent each slitter disc 26, 28 sharpen the knives.

Each double length filter plug is transferred from the plug drum 20 to a grading drum 34, which staggers the two or three filter plugs cut from one original plug. Two guide blocks 36, 38 between the plug drum 20 and the grading drum 34 are used to give each oval filter plug the same angular orientation, as disclosed in detail in copending application Ser. No. 480,809. After staggering the plugs, the grading drum 34 transfers them in a known manner to a shifting drum 40, where vacuum suction is used in known manner to draw each filter plug toward the middle portion of the surface of the drum 40, thus combining the two or three staggered parallel series of filter plugs into a single series. The filter plugs are then transferred in the known manner to an accelerating drum 42, which accelerates them to the desired speed and passes them conventionally to the feed drum 44.

At the same time, oval tobacco rods cut to the length of individual cigarettes are received from a cigarette maker. The maker feeds the filterless tobacco rods individually in staggered relationship, longitudinally onto a take-off drum 46. The single-length filterless tobacco rods then pass in the known way to the grading drums 48, where the individual tobacco rods are transferred to permit alignment for transfer to the feed drum 44. The grading drums 48 then transfer them in a known fashion or manner to the feed drum 44, on which the filter plugs are placed in the manner described. The resulting combination of filter plug and tobacco rods is moved to the swashplate drum 50, on which the tobacco rods are moved toward each other so that they abut the filter plug end-to-end. While on this drum 50, the resulting double cigarette assembly (the combination of double length filter plug and tobacco rods) receives a piece of adhesive-coated tipping material.

The tipping material is supplied in the following known manner. A roll 52 of tipping material is mounted for rotation about a horizontal axis. (Two rolls 52 are shown. As one is used up, the second is spliced to the first.) The material is pulled from the roll 52 and is led along a path defined by various rollers 54, past a bath 56 of adhesive, which is preferably heat-activatable. A roller 58 partially immersed in the bath 56 and rotating about a horizontal axis coats an adjacent applicator roller 60 with adhesive. The tipping material web is passed along the surface of the applicator roller 60 so that one surface of the web is coated with the adhesive. The tipping material is then transported to the cork drum 62, which serves as a platen to permit the tipping material, held against the drum 62 by suction, to be cut into lengths by means of knives 64 mounted on a rotating knife drum 66. Rotary brushes 68, 70 adjacent the cork knife drum 66 remove debris, dust and the like from the cork knives 64.

The rotation of the cork drum 62 brings each patch of tipping material (not shown), with the adhesive side exposed, into contact with a cigarette assembly on the swashplate drum 50. The cork drum suction on the tipping material is terminated at the moment of contact with the cigarette assembly, to which the adhesive sticks. The material contacts and adheres to the assembly along a single line, and extends from the assembly like a tab (not shown). The tipping material is then wrapped around the assembly by the rolling drum 71 of the invention, as described below.

After completion of the wrapping process, the cigarette assemblies are passed to a transfer drum 72 and thence to a cutting drum 74 adjacent which is a slitter disc knife 76. The slitter knife 76 cuts each double cigarette assembly into two cigarettes. A grinder wheel 78 adjacent the slitter disc knife 76 maintains its sharpness. The cigarettes are then moved by an additional transfer drum 80 to a turning drum 82, which reverses one of the two parallel mirror-image series of cigarettes so that all the cigarettes have the same orientation. The cigarettes proceed to an inspection drum 84, thence to an ejection drum 86 that removes any cigarette identified as defective, and finally to a catcher drum 88 that places the remaining cigarettes on two catcher belts 90 to be taken to the next machine. A guide wheel 92 above the belts 90 decelerates the cigarettes as they are placed on the belts 90.

Figure 2:
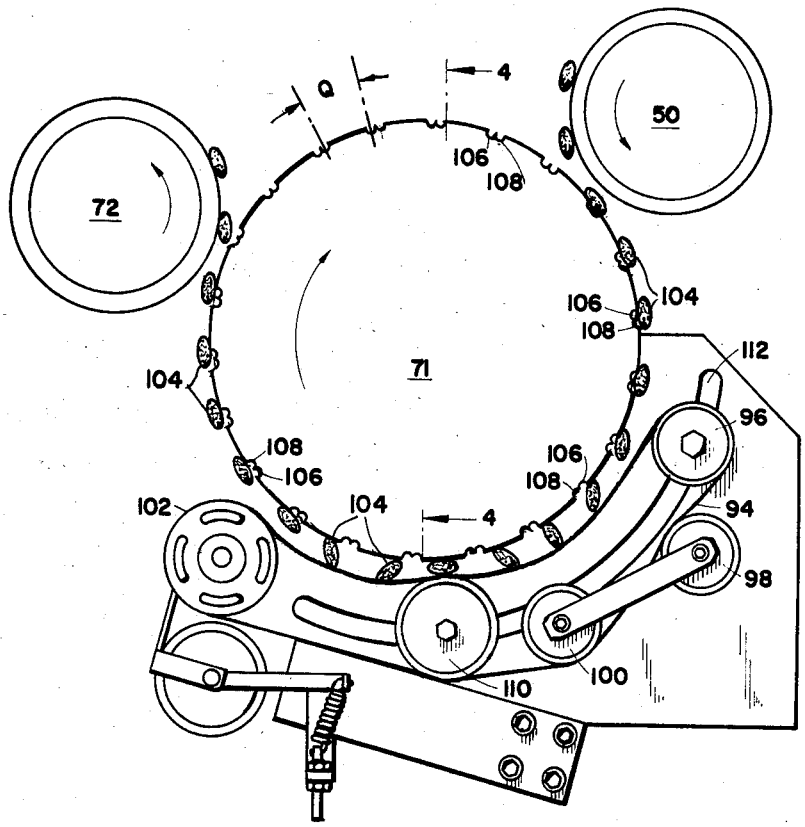
FIG. 2 is a detail of FIG. 1 showing the preferred embodiment of the apparatus for carrying out the method of the invention.

FIG. 2 shows the apparatus of the invention in greater detail. A belt 94 runs over rollers 96, 98, 100 and 102. In the absence of cigarette assemblies 104 around the periphery of drum 71, belt 94 rests against drum 71.

On a standard cigarette tipping machine, drum 71 might have 22 flutes spaced evenly around the circumference. Each flute would be spaced 37.2 mm from the next, which is one-and-one-half times the standard cigarette circumference of 24.8 mm.

Figure 2A:
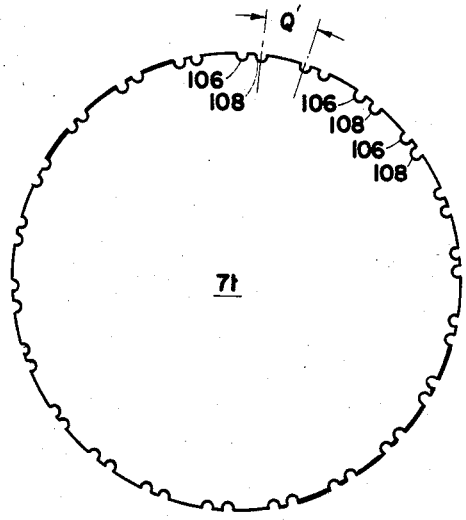
FIG. 2*a* is an elevational view of an alternate embodiment of the rolling drum of FIG. 2.
Figure 3:
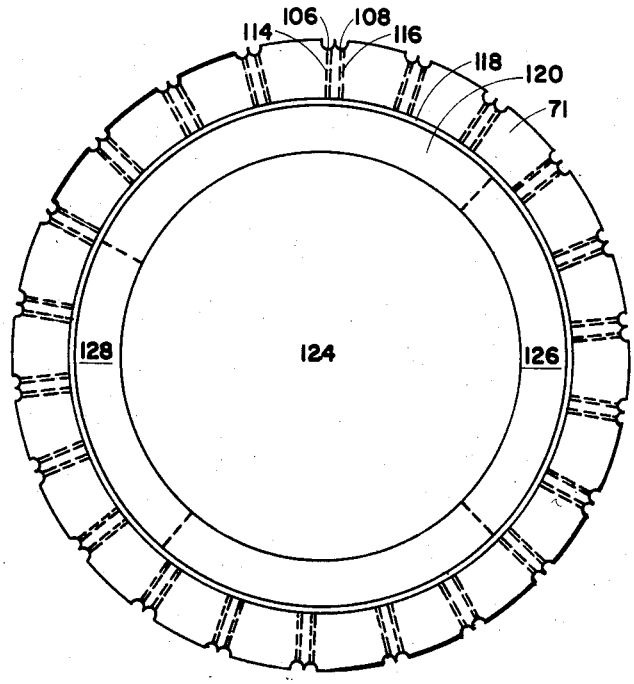
FIG. 3 is a section view of the rolling drum assembly of FIG. 2.

In order to produce non-circular cigarettes of smaller circumferences, drum 71 of this invention has two distinct sets of flutes which are offset from each other. Receiving flutes 106 are each 37.2 mm from each other, as are discharge flutes 108. The two sets of flutes 106, 108 are in turn offset from each other by a distance Q, which is one-and-one-half times the circumference of the cigarettes to be tipped. Although the distance Q in FIG. 2 is such that the discharge flute 108 of each flute pair 106, 108 is immediately adjacent the receiving flute 106 of the next flute pair 106, 108, FIG. 2*a* shows that if a cigarette with a still smaller circumference is desired, the flutes 106, 108 of each pair can be separated by a smaller distance Q', so that the discharge flute 108 of one flute pair is further from the receiving flute 106 of the next pair. However, the size of drum 71 is the same in FIGS. 2 and 2*a*, and each receiving flute is separated from its adjacent receiving flutes by 37.2 mm, as is each discharge flute from its adjacent discharge flutes, in both figures.

In operation, swashplate drum 50, rolling drum 71 and transfer drum 72 rotate as shown by the arrows in FIG. 2. Belt 94 is driven by roller 102 in the same direction as the surface of drum 71, but at a slightly slower angular speed, so that an object between belt 94 and drum 71 will roll counterclockwise along the surface of drum 71 while it is being advanced clockwise by the rotation of the drum. Suction is applied from within drum 71 to those receiving flutes 106 which are present in the region between swashplate drum 50 and roller 96, but not to the discharge flutes 108 in that region. Similarly, suction is applied to those discharge flutes 108 which are present in the region between roller 102 and transfer drum 72, but not to the receiving flutes 106 in that region. No suction is applied to any flutes in other regions of drum 71. The reason for this selective application of suction, and the valve system by which it is accomplished, will be described below in connection with FIGS. 3–5*b*.

Cigarette assemblies 104 are aligned in flutes (not shown) on swashplate drum 50 such that the major axis of the cross section of each is parallel to a line tangent to drum 50 at the point where the cigarette assembly 104 meets the drum 50. At the point where each assembly 104 is transferred from swashplate drum 50 to rolling drum 71, the same relationship exists between the major axis of the cross section of the assembly 104 and a line tangent to drum 71. Each assembly 104 is held in its respective flute by suction. At the transfer point, the suction on the flute on drum 50 is deactivated and suction is applied to receiving flute 106 of drum 71.

The cigarette assembly 104 remains aligned in receiving flute 106 until the rotation of drum 71 brings it to the nip between roller 96 and drum 71. The assembly 104 enters between belt 94 and drum 71. The suction on receiving flute 106 is deactivated, which allows cigarette assembly 104, while continuing to advance, to roll backwards along the surface of drum 71, as described above, toward discharge flute 108. This rolling motion wraps the piece of tipping material around the assembly 104. Nip roller 110, which is adjustably positioned in radial slot 112, is positioned so that the cigarette assembly 104 passes between it and drum 71 after the assembly 104 has rolled 360°, so that nip roller 110 can exert pressure along the tipping material overlap seam to seal it. Assembly 104 continues to roll backwards as it advances, completing 540°, or one-and-one-half full revolutions, by the time it reaches drive roller 102, at which point it has rolled into the first discharge flute 108 following the receiving flute 106 in which it started, and is at the desired angular orientation. Suction is applied to discharge flute 108 at that point and holds cigarette assembly 104 in place in the flute 108 until the assembly 104 is transferred to transfer drum 72, at which point the suction on discharge flute 108 is deactivated, and suction is applied to a flute (not shown) on drum 72.

By substituting a rolling drum made according to the present invention for the standard drum of a cigarette machine, an oval or any other non-circular rounded cigarette having any desired circumference less than or equal to the standard circumference can be made by choosing the offset distance Q properly.

Suction is applied selectively to flutes 106, 108 as follows: No suction is applied to the flutes in the arc between drums 72 and 50, where no cigarette assemblies 104 are present. Suction is also not applied to the arc between rollers 96 and 102 because the cigarette assemblies 104 are held against drum 71 by belt 94, and because in the absence of cigarette assemblies between the drum 71 and the belt 94, the belt would be sucked against the drum, causing it to override drive roller 102. In the arc between swashplate drum 50 and roller 96, suction is applied only to receiving flutes 106. This is done because cigarette assemblies are present only in those flutes in that arc. If suction were applied to discharge flutes 108 in that arc, there would be a loss of vacuum in the vacuum system because the discharge flutes 108 in that arc are open to the atmosphere, and there would also be a possibility that some of the cigarette assemblies would fall from the drum 71 at production speed. For the same reasons, in the arc between roller 102 and transfer drum 72, suction is applied only to discharge flutes 108 and not to receiving flutes 106.

The vacuum valve system for applying suction selectively as explained above is described with reference to FIGS. 3–5*b*.

Figure 4:
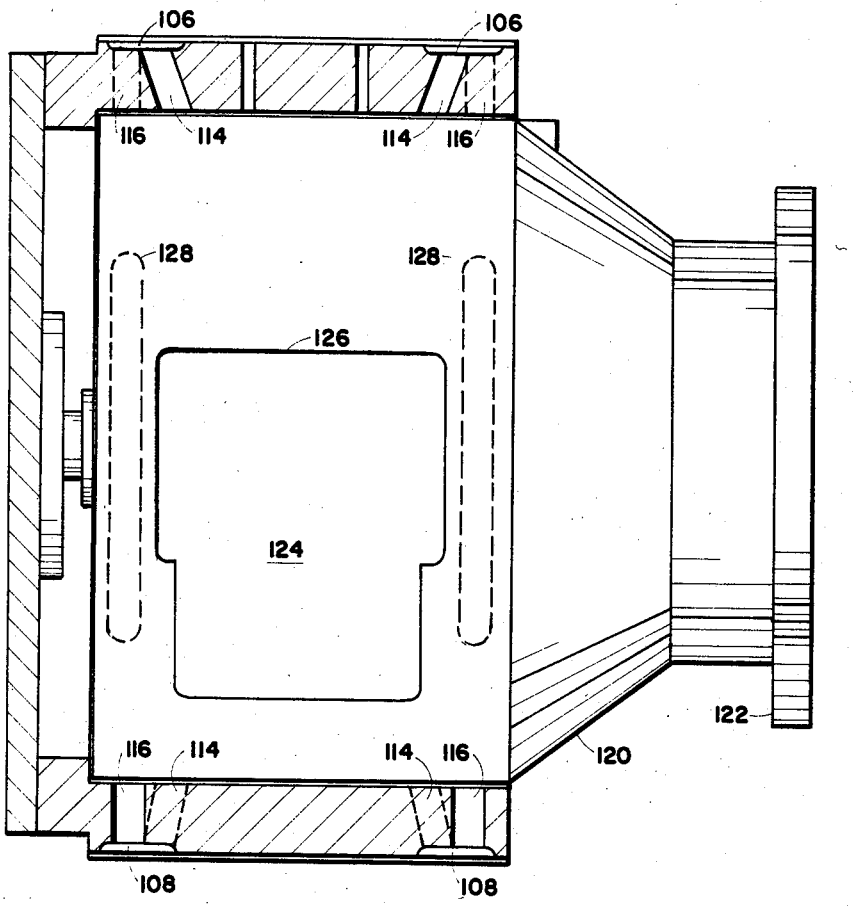
FIG. 4 is a section view of the rolling drum assembly taken from line 4—4 of FIG. 2.
Figure 5A:
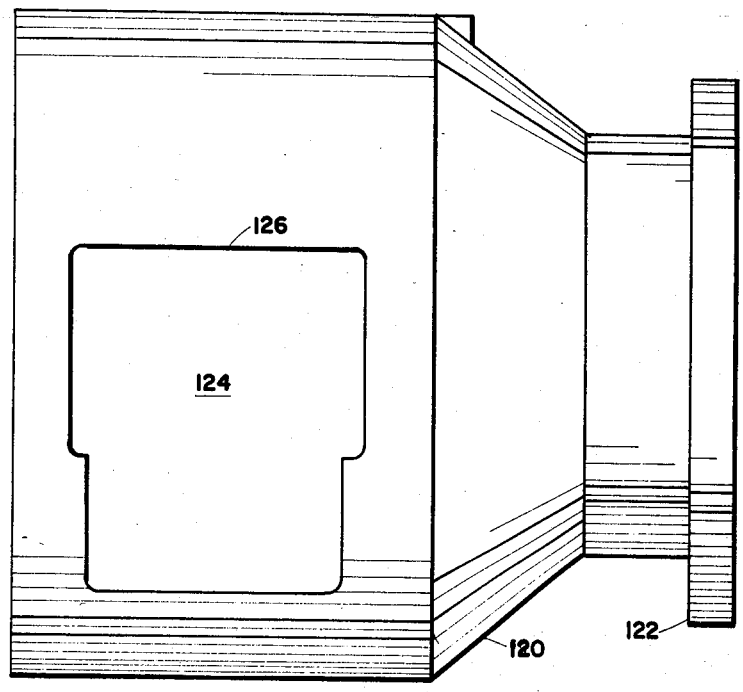
FIG. 5*a* is an elevational view of the vacuum valve of the invention seen from the right side as shown in FIG. 1.
Figure 5B:
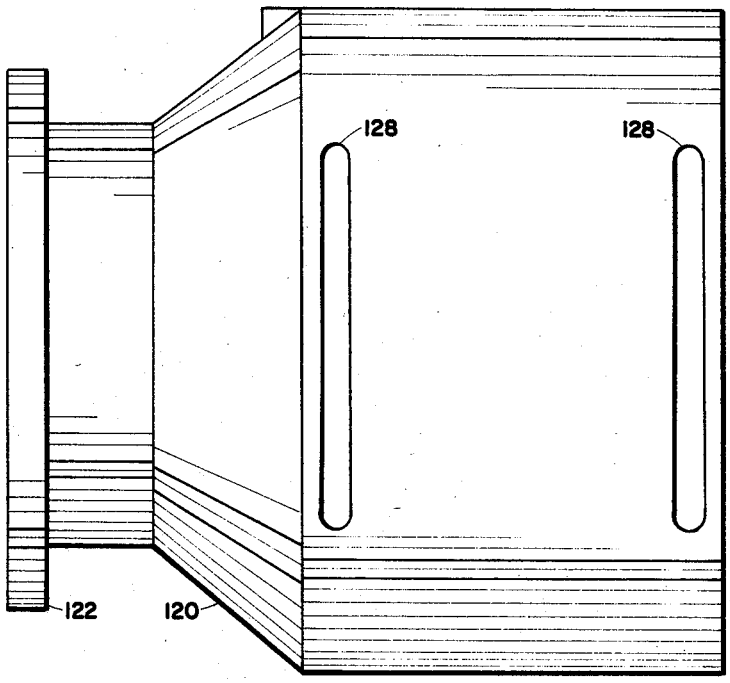
FIG. 5*b* is an elevational view of the vacuum valve of the invention seen from the left side as shown in FIG. 1.

Suction ports 114 and 116 extend from receiving flutes 106 and discharge flutes 108, respectively, to the interior 118 of drum 71. As can be seen in FIG. 4, each flute has a pair of suction ports, one for each half of a double cigarette assembly 104.

Within drum 71 is a cylindrical vacuum valve 120, connected at 122 to a source of vacuum (not shown). Valve 120 is a hollow cylinder, enclosing a vacuum chamber 124. In the arc between swashplate drum 50 and roller 96, valve 120 has a receiving flute suction orifice 126 in its cylindrical wall. Receiving flute suction orifice 126 is positioned and dimensioned so that receiving flute suction ports 114 pass over it, but discharge flute ports 116 do not, thereby applying suction only to the receiving flutes 106 in the arc between swashplate drum 50 and roller 96. In the arc between roller 102 and transfer drum 72, valve 120 has two narrow, elongated discharge flute suction orifices 128 in its cylindrical wall. Discharge flute suction orifices 128 are positioned and dimensioned so that discharge flute suction ports 116 pass over them, but receiving flute ports 114 do not, thereby applying suction only to the discharge flutes 108 in the arc between roller 102 and transfer drum 72. As shown in FIG. 4, receiving flute suction ports 114 are bored at an angle to increase the separation distance between them and discharge flute suction ports 116 on the inner surface of drum 71. This is necessary because although the clearance between the inner surface of drum 71 and the outer surface of valve 120 is sufficient to allow the drum 71 to rotate freely about the valve 120, it is not small enough to prevent bleed-over of vacuum between ports 114 and ports 116.

The present invention thus enables the production of non-circular cigarettes having any circumference smaller than the circumference of a standard cigarette by providing separate receiving and discharge flutes on the rolling drum of a standard cigarette machine, and a vacuum system for selectively applying suction to desired sets of flutes.

With the present invention, it has been found possible to wrap oval cigarettes at rates (up to 5,000 cigarettes per minute) comparable to those attained with round cigarettes using conventional machinery.

Although the invention has been particularly described with reference to the preferred embodiments thereof, many modifications and variations thereof will now be apparent to those skilled in the art. Accordingly, the scope of the invention is to be determined not by the details of the illustrated embodiment described herein, but only by the terms of the appended claims.

What is claimed is:

1. A cigarette tipping machine comprising: means for moving a non-circular filter plug along a predetermined filter plug path and for moving a non-circular tobacco rod along a part of said filter plug path in axial alignment with such filter plug; means for applying an adhesive tipping sheet to an assembly comprising such a filter plug and tobacco rod; rolling means for overlappingly wrapping such a tipping sheet around such an assembly to secure the filter plug and the tobacco rod together; said rolling means including a rolling drum adapted to receive such assemblies in a plurality of uniformly spaced-apart receiving flutes on the periphery of said rolling drum and to discharge such assemblies from a plurality of uniformly spaced-apart discharge flutes on the periphery of said drum, said discharge flutes being separate and distinct from said receiving flutes, the distance between adjacent ones of said discharge flutes being the same as the distance between adjacent ones of said receiving flutes; a first pressure element adjacent said rolling drum, said first pressure element and said rolling drum defining a rolling path therebetween; and means for driving said first pressure element and said rolling drum in the same angular direction but with different angular speeds about the axis of said rolling drum, for causing each such assembly to move along said rolling path by rolling relative to the periphery of said rolling drum, while subject to pressure exerted by said pressure element, from that one of said receiving flutes in which it is received to the first one of said discharge flutes following said one of said receiving flutes.

2. The cigarette tipping machine of claim 1 further comprising a second pressure element urging said first pressure element toward said rolling drum at one point in said rolling path to exert momentary slightly increased pressure along the line of overlap of said tipping sheet.

3. The cigarette tipping machine of claim 1 further comprising means for selectively applying suction from the interior of said rolling drum exclusively to said receiving flutes in a first region of said drum and exclusively to said discharge flutes in a second region of said drum.

4. The cigarette tipping machine of claim 3 wherein said drum is hollow and has an inner surface and an interior space, and said means for selectively applying suction comprises:

at least one port communicating between each of said receiving and discharge flutes and said interior of said drum; and a cylindrical vacuum valve disposed within said interior of said drum and having an interior vacuum chamber;

said valve having at least one receiving flute suction orifice extending over said first region of said drum in fluid communication with said vacuum chamber and with said ports which communicate with said receiving flutes; and said valve having at least one discharge flute suction orifice extending over said second region of said drum in fluid communication with said vacuum chamber and with said ports which communicate with said discharge flutes.

5. The cigarette tipping machine of claim 4 wherein said valve has two narrow elongated discharge flute suction orifices.

6. A rolling assembly for a cigarette tipping machine, said rolling assembly comprising:

a rolling drum having:

a plurality of uniformly spaced-apart receiving flutes on the periphery thereof for receiving cigarette assemblies; and a plurality of uniformly spaced-apart discharge flutes on the periphery thereof for discharging cigarette assemblies;

said discharge flutes being separate and distinct from said receiving flutes;

the distance between adjacent ones of said discharge flutes being the same as the distance between adjacent ones of said receiving flutes; and said rolling assembly further comprising means for selectively applying suction from the interior of said rolling drum exclusively to the receiving flutes in a first region of said drum, and exclusively to the discharge flutes in a second region of said drum.

7. The rolling assembly of claim 6 wherein said drum is hollow and has an inner surface and an interior space, and said means for selectively applying suction comprises:

at least one port communicating between each of said receiving and discharge flutes and said interior of said drum; and a cylindrical vacuum valve disposed within said interior of said drum and having an interior vacuum chamber;

said valve having at least one receiving flute suction orifice extending over said first region of said drum in fluid communication with said vacuum chamber and with said ports which communicate with said receiving flutes; and said valve having at least one discharge flute suction orifice extending over said second region of said drum in fluid communication with said vacuum chamber and with said ports which communicate with said discharge flutes.

8. The rolling assembly of claim 7 wherein said valve has two narrow elongated discharge flute suction orifices.

9. A method for rolling a non-circular cigarette assembly including a tobacco rod and a filter plug joined by a piece of tipping material to overlappingly wrap such tipping material around such cigarette assembly to secure such filter plug firmly to such tobacco rod, comprising the steps of:

providing such a cigarette assembly at a feed point, with a first predetermined angular orientation, to a receiving flute on a rolling drum having a plurality of uniformly spaced-apart receiving flutes and a plurality of uniformly spaced-apart discharge flutes on the peripheral surface thereof, said discharge flutes being separate and distinct from said receiving flutes, the distance between adjacent ones of said discharge flutes being the same as the distance between adjacent ones of said receiving flutes;

applying suction selectively from the interior of said drum exclusively to said receiving flutes in the region of said feed point;

advancing said drum rotationally until said cigarette assembly contacts a first pressure element;

deactivating said suction on said receiving flute;

rotating said rolling drum in a first direction with a predetermined angular speed about the axis of said rolling drum;

simultaneously moving said first pressure element generally parallel to said peripheral surface of said rolling drum with a second predetermined angular speed with respect to said axis, said second angular speed being different from said first angular speed, to roll said cigarette assembly along said peripheral surface of said rolling drum from the receiving flute in which it is received toward the first one of said discharge flutes following said receiving flute;

advancing said rolling drum rotationally until said cigarette assembly clears said first pressure element;

applying suction selectively from the interior of said rolling drum exclusively to said discharge flutes in the region in which said cigarette assembly clears said first pressure element;

rotating said rolling drum until said cigarette assembly reaches a transfer point;

deactivating said suction on said discharge flute; and transferring said cigarette assembly to a transfer drum.

10. The method of claim 9 further comprising, at a predetermined point around the peripheral surface of said rolling drum, exerting slight additional pressure against said cigarette assembly substantially only at the line of overlap of the tipping material.

11. The method of claim 9 wherein said rotating and moving steps are performed continuously for a sufficient total length of time to roll said cigarette assembly along said peripheral surface of said rolling drum until said cigarette assembly has revolved one-and-one-half times about its own axis.

* * * * *